US005172863A

United States Patent [19]

Melone et al.

[11] Patent Number: 5,172,863

[45] Date of Patent: Dec. 22, 1992

[54] TOY DOLL DISPENSER FOR FLUIDS

[75] Inventors: Georgina M. Melone, Bristol, R.I.; Roseann Radosevich, New Bedford, Mass.; Fred D. Eddins, Mapleville, R.I.

[73] Assignee: Hasbro, Inc., Pawtucket, R.I.

[21] Appl. No.: 831,484

[22] Filed: Feb. 5, 1992

[51] Int. Cl.[5] ..... B67D 1/04

[52] U.S. Cl. ..... 239/211; 222/78; 222/103; 239/327; 446/475

[58] Field of Search ..... 222/78, 103; 239/211, 239/327; 446/475

[56] References Cited

U.S. PATENT DOCUMENTS

| | | | |
|---|---|---|---|
| D. 56,667 | 11/1920 | Haines . | |
| D. 255,476 | 6/1980 | Cox | D21/169 |
| D. 317,341 | 6/1991 | Cardillo | D21/169 |
| 1,191,134 | 7/1916 | McCaslin | 222/78 X |
| 1,767,911 | 6/1930 | Berko et al. | 222/78 X |
| 2,159,894 | 5/1939 | Hines . | |
| 2,513,506 | 7/1950 | Mendelson | 222/78 X |
| 2,615,758 | 10/1952 | Alexander | 222/78 X |
| 2,723,050 | 11/1955 | Montgomery et al. | 222/103 |
| 3,444,645 | 5/1969 | Tepper et al. . | |
| 4,185,413 | 1/1980 | Goldfarb et al. | 222/78 X |
| 4,982,874 | 1/1991 | Pringle | 222/78 |
| 5,071,387 | 12/1991 | Pottick | 222/78 X |

FOREIGN PATENT DOCUMENTS

| | | | |
|---|---|---|---|
| 186381 | 10/1955 | Fed. Rep. of Germany | 222/103 |

*Primary Examiner*—Kevin P. Shaver

*Attorney, Agent, or Firm*—Salter, Michaelson & Benson

[57] ABSTRACT

A dispenser for fluids includes a doll body having a pair of pivotally mounted wings thereon and a dispensing assembly in the doll body. The dispensing assembly includes a collapsible reservoir for containing a fluid in the torso portion of the doll body, an atomizer nozzle assembly for passing the fluid outwardly of the doll body and a linkage assembly which is responsive to pivotal movement of the wings for collapsing the reservoir in order to dispense the fluid therefrom.

1 Claim, 2 Drawing Sheets

TOY DOLL DISPENSER FOR FLUIDS

BACKGROUND AND SUMMARY OF THE INVENTION

The instant invention relates to toys, and more particularly to a dispenser for fluids, particularly perfumes, which is adapted for use by young girls.

The concept of applying various cosmetics, including various perfumes, to one's body has generally been found to be particularly appealing to young girls. However, because most perfumes are relatively expensive and intended for use by adults rather than children, they have generally not been made readily available to young children. Further, the heretofore available perfumes have generally not been packaged in dispensers which are designed to have added appeal for young children.

The instant invention provides an effective dispenser for fluids which can be effectively utilized for dispensing scented liquids, such as various perfumes, and which is particularly adapted to have increased appeal for young children. Specifically, the dispenser of the instant invention includes a doll body which is preferably formed in the configuration of a character figure having a pair of wings thereon, and a dispensing assembly in the doll body which is operative in response to pivoting movement of the wings for dispensing a fluid, such as a perfume, from the doll body. Still more specifically, the dispenser includes a doll body comprising a torso portion and a pair of limbs which are pivotally mounted on the torso portion, a deformable reservoir in the torso portion for containing a fluid, and a nozzle for dispensing a fluid from the reservoir, so that it passes outwardly of the doll body. The dispenser further includes a linkage assembly between the limbs and the reservoir for deforming the reservoir in order to dispense a fluid therefrom in response to a predetermined pivotal movement of the limbs. The limbs preferably comprise wings on the torso portion which are pivotable together for deforming the reservoir, and the fluid preferably comprises a scented perfume liquid. The nozzle is preferably operative for atomizing liquid as it is dispensed from the dispenser, and the nozzle preferably extends through a head portion of the doll body for dispensing fluid, so that it passes outwardly from the head portion.

It has been found that the dispenser of the instant invention can be effectively utilized for dispensing a liquid, such as perfume, and that it has particular appeal for young children. Specifically, it has been found that the wings of the dispenser can be effectively pivoted together in order to dispense a liquid from the dispenser nozzle. It has been further found that because the dispenser is adapted to be formed in a configuration of a toy doll, preferably one which embodies a human-like character figure, it has a substantially increased level of appeal for young children.

Accordingly, it is a primary object of the instant invention to provide an effective perfume dispenser for young children.

Another object of the instant invention is to provide an effective dispenser for fluids which has particular appeal for young children.

An even still further object of the instant invention is to provide an effective dispenser for fluids which is formed in the configuration of a human-like character figure having a pair of wings thereon, and which is operative by pivoting the wings together.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
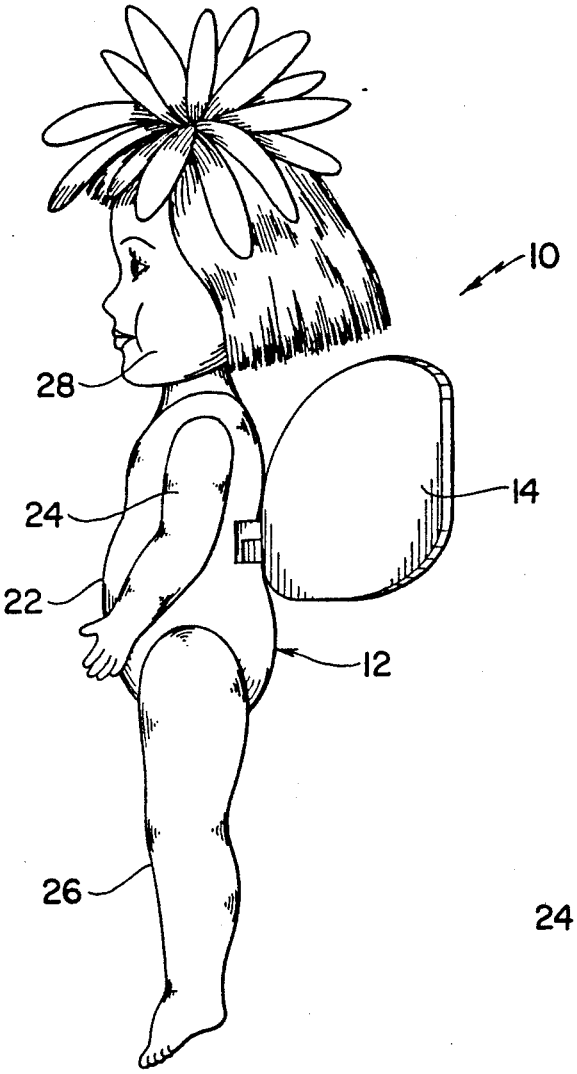
FIG. 1 is a side elevational view of the dispenser of the instant invention.
Figure 2:
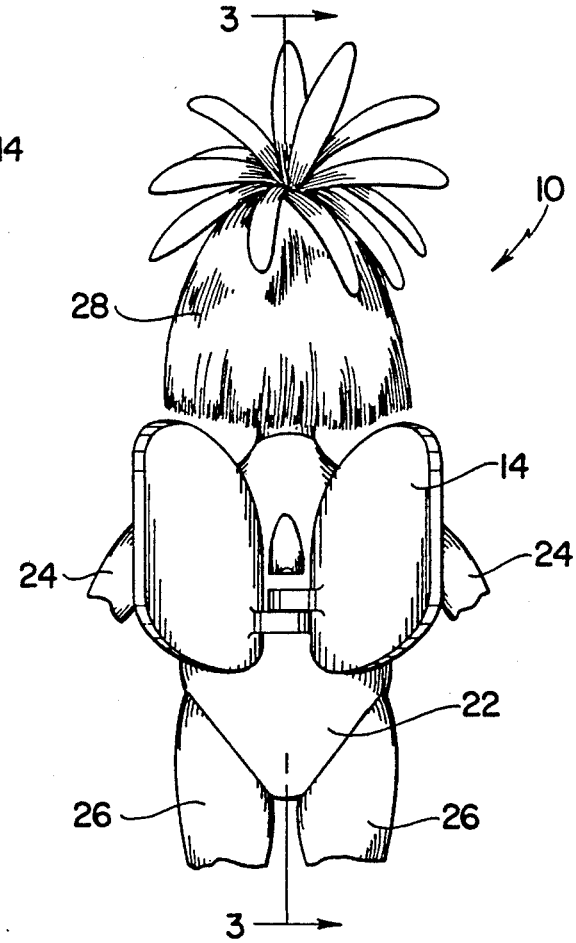
FIG. 2 is a fragmentary rear elevational view thereof.
Figure 3:
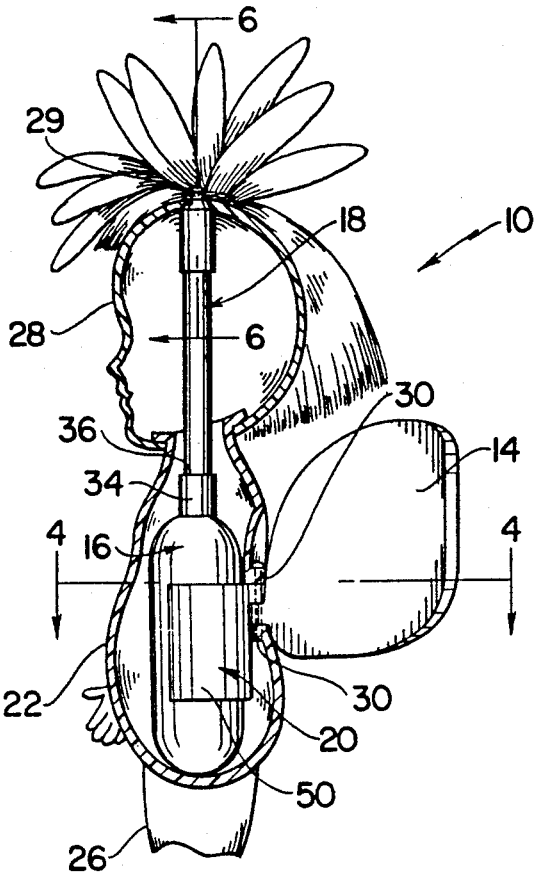
FIG. 3 is a sectional view taken along line 3—3 in FIG. 2.
Figure 4:
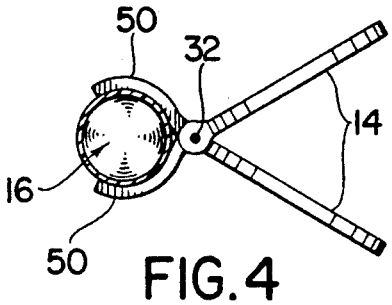
FIG. 4 is a sectional view taken along the line 4—4 in FIG. 3.
Figure 5:
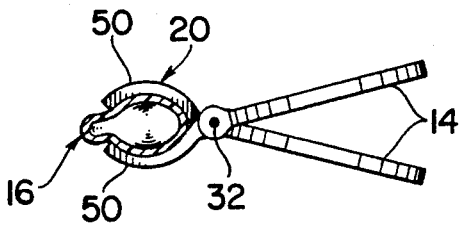
FIG. 5 is a similar sectional view with the wings pivoted together.
Figure 6:
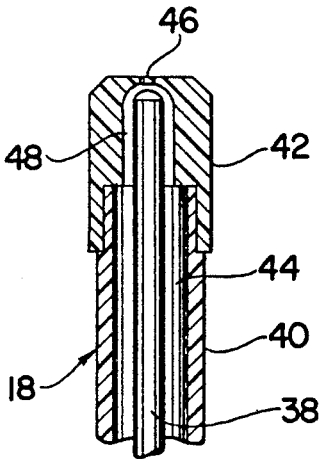
FIG. 6 is a sectional view taken along the line 6—6 in FIG. 3.

Referring now to the drawings, the dispenser of the instant invention is illustrated in FIGS. 1 through 6, and generally indicated at 10 in FIGS. 1 through 3. The dispenser 10 comprises a body portion generally indicated at 12 including a pair of wings generally indicated at 14, a dispenser reservoir generally indicated at 16 in the body portion 12, a nozzle 18 in the body portion 12, and a linkage mechanism generally indicated at 20. The reservoir 16 is adapted to be filled with a suitable fluid, such as a scented liquid perfume, and it is deformable for dispensing the fluid therefrom. The wings 14 are connected to the linkage mechanism 20, and they are pivotally mounted on the body portion 12, so that the wings 14 are pivotable together for collapsing the reservoir 16 in order to dispense a fluid therefrom.

The body portion 12 is preferably made from a suitable plastic material in the configuration of a doll character figure, and it includes a torso portion 22, a pair of arms 24, a pair of legs 26, a head portion 28 having an aperture 29 therein, and the wings 14. The wings 14 are pivotally mounted on the back of the torso portion 22 with a pair of pivot mounts 30 which are integrally formed on the back of the torso portion 22, and a pivot pin 32 extends through the mounts 30 for securing the wings 14 thereto.

The reservoir 16 comprises a flexible bulb which is adapted for containing a fluid, such as a liquid perfume, and it is assembled in the interior of the torso portion 22. The reservoir 16 is preferably made from a suitable elastomeric material, and it is deformable or collapsible for dispensing a fluid therefrom. The reservoir 16 includes an upper neck portion 34 having an open mouth 36, and it is assembled in a substantially vertical disposition in the torso portion 22.

The nozzle portion 18 is operative for passing fluid from the reservoir 16 through the head portion 28, so that it passes outwardly through the aperture 29. The nozzle portion 18 comprises an inner tube 38, an outer tube 40, and an atomizer tip 42. The inner tube 38 extends downwardly a substantial distance into the reservoir 16 for drawing fluid outwardly therefrom, and the outer tube 40 is received in sealing engagement in the neck portion 36, so that it is disposed in concentric relation with the inner tube 38. The inner tube 38 and the outer tube 40 cooperate to define an annular passage 44 therebetween which is operative for delivering air to the atomizer tip 42 from the reservoir 16. The atomizer tip 42 is of conventional construction, and it is secured to the head portion 28. The atomizer tip 42 has outlet aperture 46 formed therein and a plurality of interior air channels 48 which communicate with the passage 44 for delivering air to the outlet aperture 46. The inner tube 38 terminates in closely spaced relation to the aperture 46. Accordingly, when the reservoir 16 is collapsed or deformed liquid is forced outwardly through the tube 38 while air is forced outwardly through the annular passage 44, and the air and liquid are mixed in the area between the terminal end of the tube 38 and the aperture 46, so that they pass outwardly from the nozzle 42 as an atomized liquid-air mixture.

The linkage mechanism 20 comprises a pair of arms 50, each of which is integrally connected to one of the wings 14 for pivoting therewith about the axis of the pivot pin 32. As illustrated most clearly in FIGS. 4 and 5, the arms 50 are of arcuate configuration, and they are assembled around the reservoir 16. Accordingly, when the wings 14 are pivoted together, the arms 50 are also pivoted together in a scissors-like manner to collapse the reservoir 16. In this regard, the wings 14 are pivotable from the first position illustrated in FIG. 4, wherein the reservoir 16 is in a substantially undeformed configuration, to the second position illustrated in FIG. 5, wherein the reservoir 16 is in a substantially deformed or collapsed configuration for forcing air and liquid outwardly from the reservoir 16 through the nozzle assembly 18.

It is seen therefore that the instant invention provides an effective dispenser for fluids. The dispenser 10 is adapted to be formed in the configuration of an amusing character figure having wings 14 thereon, and it is operative by pivoting the wings 14 together for collapsing the reservoir 16 to dispense a fluid therefrom. As a result of these unique structural features, the dispenser 10 has particular appeal for young children, and it can be effectively utilized for dispensing relatively inexpensive perfumes for young girls. Consequently, the dispenser of the instant invention is felt to represent a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A dispenser for a fluid comprising:

a. a human-like doll body including a head portion and a substantially rigid torso portion having a back portion;

b. a pair of substantially rigid wings;

c. pivot mounting means for pivotally mounting said wings on said back portion for pivoting said wings together and apart thereon about a pivot axis;

d. a reservoir in said torso portion for containing the fluid, said reservoir being deformable for dispensing the fluid therefrom;

e. atomizer means for atomizing the fluid as it is dispensed from said reservoir so that the fluid passes outwardly in an atomized stream from said head portion; and f. linkage means extending inwardly into said torso portion rom each of said wings, said linkage means being pivotable with said wings in a scissors-like manner, said linkage means cooperating to deform said reservoir in order to dispense the fluid therefrom as said wings are pivoted together.

* * * * *